US005110037A

United States Patent [19]

Pieritz, Sr.

[11] Patent Number: 5,110,037

[45] Date of Patent: May 5, 1992

[54] CONTAINER AND METHOD OF MAKING SAME

[75] Inventor: John R. Pieritz, Sr., Milan, Ill.

[73] Assignee: Rock Island Packaging Corp., Milan, Ill.

[21] Appl. No.: 718,049

[22] Filed: Jun. 20, 1991

[51] Int. Cl.[5] ..... B65D 5/42

[52] U.S. Cl. ..... 229/23 A; 206/386; 206/600; 229/23 R; 493/162; 493/183

[58] Field of Search ..... 229/23 A, 23 R; 206/386, 600; 493/162, 183, 453

[56] References Cited

U.S. PATENT DOCUMENTS

| | | | |
|---|---|---|---|
| 1,245,369 | 11/1917 | McMillan et al. | 229/23 A |
| 3,608,813 | 9/1971 | Blasdell | 229/23 A |
| 4,089,417 | 5/1978 | Osborne | 229/23 A |
| 4,119,205 | 10/1978 | Delany | 206/600 |
| 4,296,860 | 10/1981 | Hsu et al. | 229/23 R |
| 4,445,614 | 5/1984 | Mitsumori et al. | 206/599 |
| 4,852,735 | 8/1989 | Ortlieb et al. | 229/23 A |
| 4,927,026 | 5/1990 | Gossler et al. | 206/600 |

FOREIGN PATENT DOCUMENTS

| | | | |
|---|---|---|---|
| 2531409 | 2/1984 | France | 229/23 R |

*Primary Examiner*—Gary E. Elkins
*Attorney, Agent, or Firm*—Henderson & Sturm

[57] ABSTRACT

A container especially of the palletized type, made of a single rectangular sheet of fiber board or the like in which the sheet is cut inwardly at its four edges to provide four panels that make up the ends and sides of a box-like structure leaving the uncut portion as a rectangular of smaller but similar shape. In addition to the four panels, the cutting operating provides four corner panels separated from the other panels but integral with the bottom. These corner panels are folded beneath and lie flat-wise against the bottom to give the bottom a double thickness. In addition, portions of the folded-under corner parts project laterally beyond the periphery of the box-like structure to provide a peripheral lip serving as a stop for a tubular cover element that is ultimately slipped over the structure for shipping.

10 Claims, 2 Drawing Sheets

CONTAINER AND METHOD OF MAKING SAME

BACKGROUND AND SUMMARY OF THE INVENTION

The prior art is replete with palletized containers made of fiber board, such as corrugated cardboard and the like, representative examples being disclosed in the following U.S. Pat. Nos. : Hsu, et al. 4,296,860, Gossler, et al. 4,927,026 and Mitsumori, et al. 4,445,614. Each of these is of multi-piece construction of varying degrees of complexity involving relatively high cost. According to the present invention, a novel one-piece, no waste, economical structure is provided from a single rectangular sheet or blank so cut as to provide side and end panels attached to and adapted to project upright from a flat one-piece bottom. The cutting operation also leaves four corner parts or panels attached to the bottom, and these are folded under, flatwise against, the bottom and affixed thereto to give the bottom a double thickness. The configuration of each of the folded-under parts is such as to combine to establish a peripheral lip serving as a stop for a tubular upper member which surrounds the side and end panels, having its lower marginal edge resting on the peripheral lip, which functions as a locator for the tubular member.

Further features and advantages of the invention will become apparent as a preferred embodiment is disclosed in the ensuing description and accompanying drawings.

DETAILED DESCRIPTION OF A PREFERRED EMBODIMENT OF THE INVENTION

Figure 1:
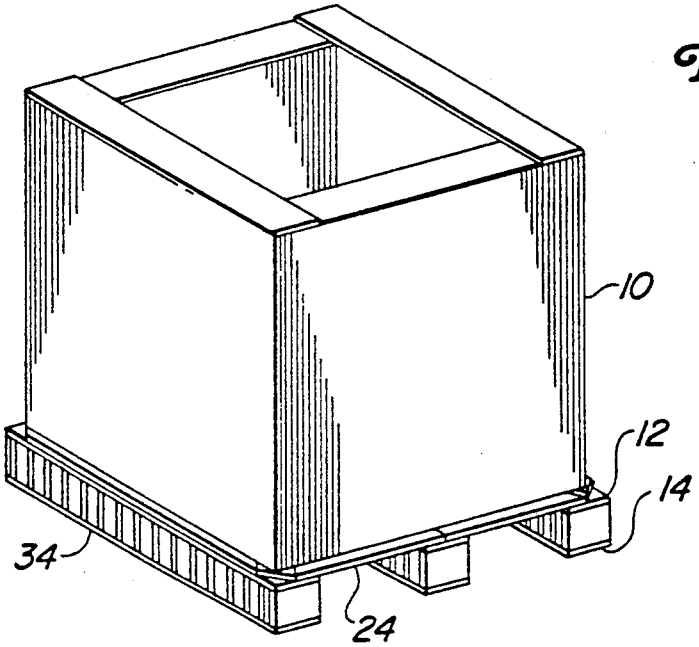
FIG. 1 is a perspective of an assembled shipping container involving a lower unit constructed according to the invention.
Figure 2:
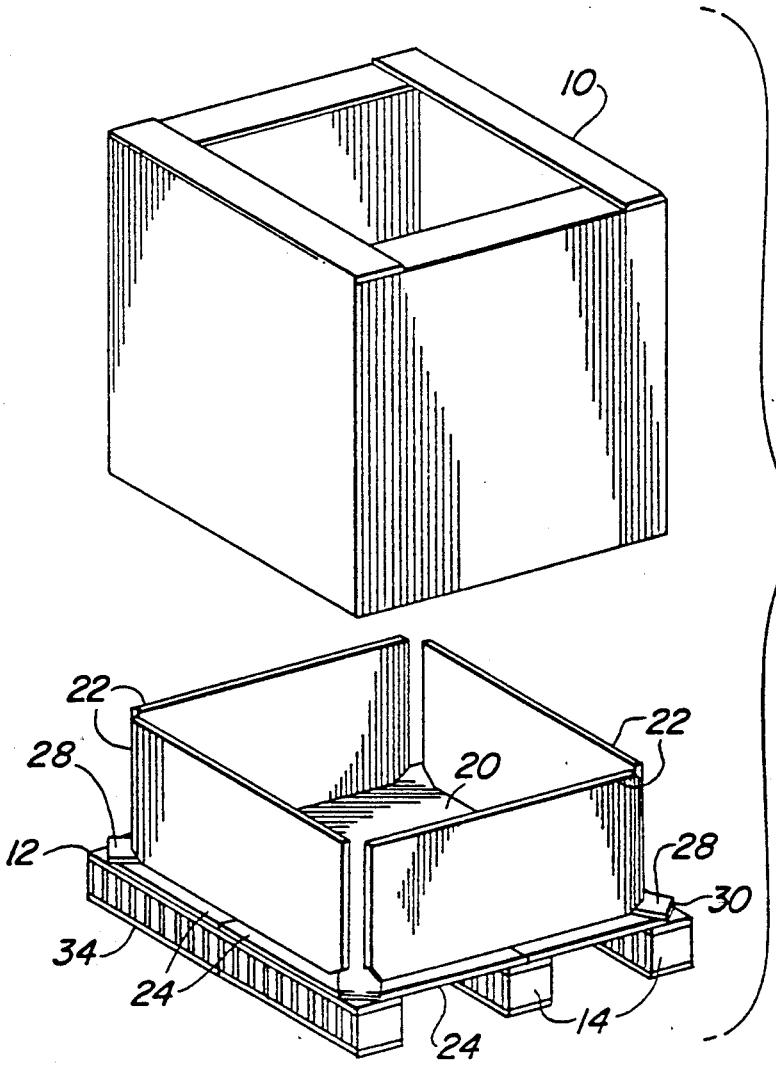
FIG. 2 is an exploded perspective showing the upper and lower units separated from each other.
Figure 5:
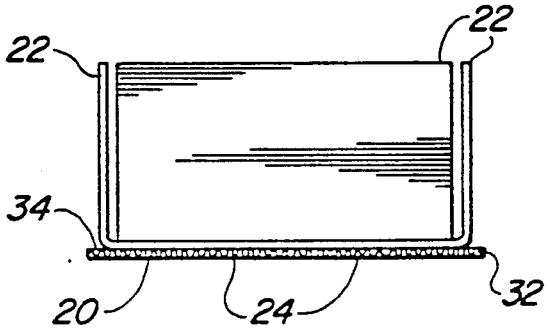
FIG. 5 is an end view of the completed lower unit with pallet skids omitted.

As best seen in FIGS. 1 and 2, a representative total container is made up of an upper unit 10 enclosing the upper portion of a lower unit 12 which is provided with skids 14. The whole is typically made up of fiber board such as corrugated cardboard, examples of which in general appear in the above-noted U.S. patents. The upper part is also generally typical of the prior art, at least to the extent that it partly encloses and confines the lower part against opening during shipping. Hence, the present disclosure will pertain primarily to the lower part 12, hereinafter referred to as a box-like structure best seen in the lower half of FIG. 2 and also in FIG. 5. The details of how the structure is formed of several panels will appear as the description progresses.

Figure 3:
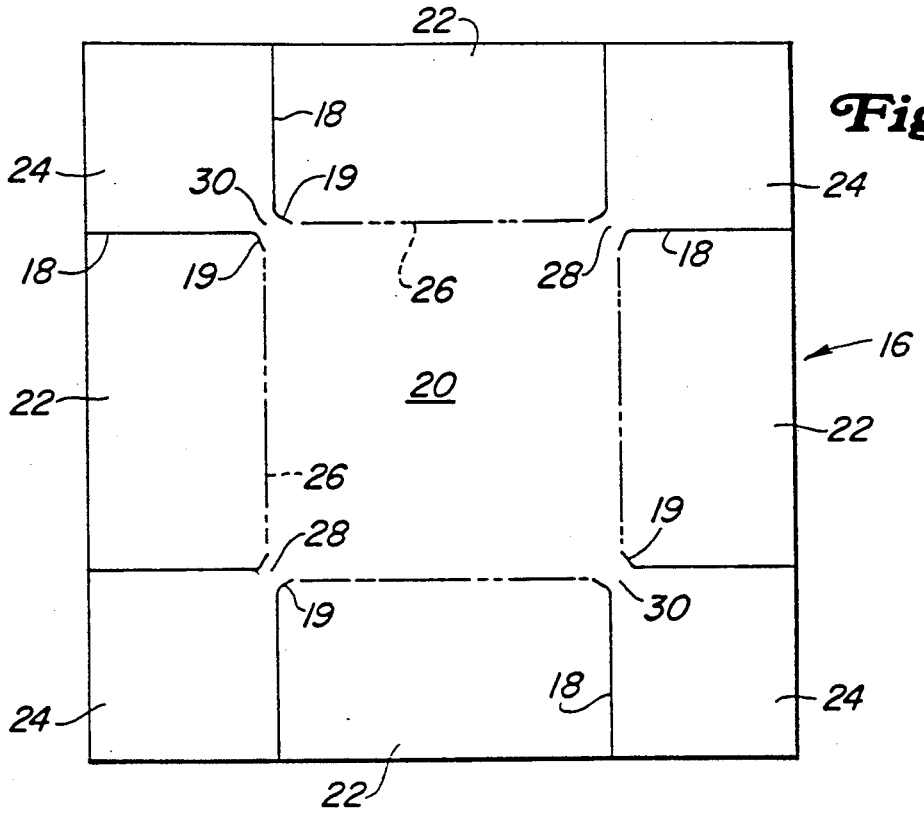
FIG. 3 is a plan of the sheet or blank from which the lower container unit is formed.

FIG. 3 shows the starting, one-piece rectangular sheet or blank 16, here preferably a square having a plurality of cuts 18 extending inwardly from all four sides of the sheet and terminating substantially at the four corners of a smaller, similar rectangle or square 20 centered within the sheet. The cutting operation may be achieved by dies or the like gaged to lie at right angles to the side of the square and to terminate as aforesaid. The cutting operation thus leaves rectangular end and side panels 22 as well as square corner panels or portions 24. The junctions of the panels 22 with the bottom 20 will be seen at 26 and these junctions will form lines along which the sheet may be scored to enable easier bending of the panels 22 upwardly relative to the bottom so as to provide the boxlike structure previously referred to. See FIG. 2, bottom half.

The cutting operation extends each cut 18 at an angled short cut 19 so as to leave each corner portion 24 joined to the bottom at a relatively narrow, somewhat elongated neck 28 that lies on a diagonal extended of the bottom or central portion 20. Lines 30 indicate that each neck may be scored transverse to its length, or at ninety degrees thereto, to enable folding of each corner beneath and flatwise against the underside of the bottom 20, thereby giving the bottom a double thickness. The corners 24 may be affixed to the underside of the bottom in any suitable manner; e.g., stapling, gluing, etc. The skids 14 may be attached later, if skids are to be used.

Figure 4:
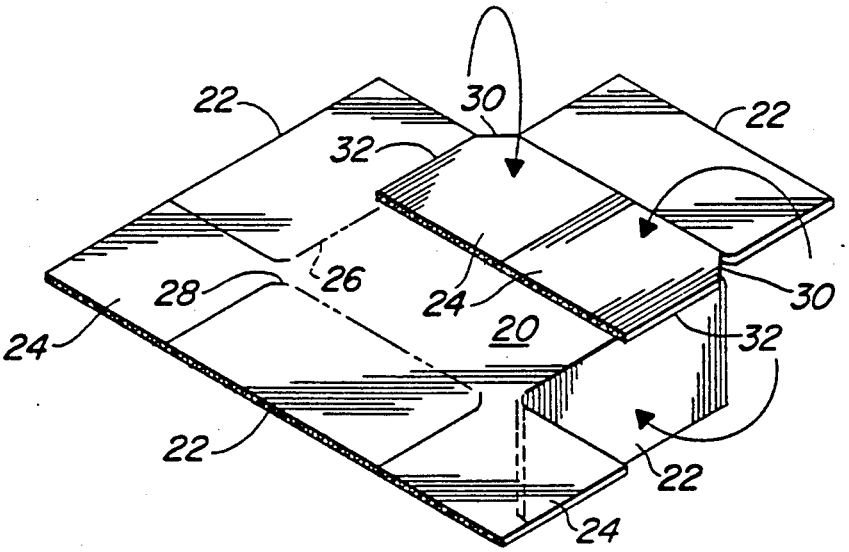
FIG. 4 is a perspective showing steps in the bending and folding steps for construction of the unit.

In general, in a square configuration, each corner 24 is a square having an area about one-fourth that of the bottom 20. In the present case, the area of each square corner will slightly exceed the one-fourth dimension so that angularly related edges of each corner will project laterally beyond the box-like structure as best seen at 32. See FIG. 4, where it will be clear that, when all four corners are folded beneath the underside of the bottom 20, they cover the bottom and the edges 32 cooperate to provide a peripheral lip 34 bordering the structure. AS will be apparent from FIG. 1, this lip serves as a stop or support for the lower marginal edge of the tubular upper member 10.

One of the main features of the invention is that the lower container unit is formed from one piece, with no additions and no waste. Another significant feature is the doubling of the thickness of the bottom, which increases the strength of the bottom by up to two and one-half times that of a single thickness. A third feature is the peripheral lip. All of these features flow from each other to provide the improved box-like structure. Features and advantages other than those pointed out will occur to those versed in the art, as will many modifications of the preferred structure and method disclosed, all without departure from the spirit and scope of the invention.

I claim:

1. The method of making a container from a single rectangular sheet of fiber board, comprising cutting the sheet inwardly at each of sides of said sheet via two cuts per side with each cut terminating substantially at a corner of an imaginary similar smaller rectangle centered within the sheet whereby to provide a pair of end panels, a pair of side panels and four corner panels all connected to the smaller rectangle, bending the side and end panels upwardly relative to the smaller rectangle at 90° to the smaller rectangle so as to form a structure of which the smaller rectangle provides a horizontal bottom, and folding the corner panels beneath and lying flatwise against the bottom so as to give the bottom a double thickness.

2. The method according to claim 1, including affixing the folded corner panels to the bottom.

3. The method according to claim 1, in which each corner panel is so configured that, when folded under the bottom, each of said corner panels has edge portions projecting horizontally laterally beyond the bent up side and end panels.

4. The method according to claim 3, in which the configuration of the folded corner panels is such as to provide a peripheral lip projecting beyond the bent up end and side panels and bordering the bottom.

5. The method according to claim 1, in which the sheet is a square, cutting the sheet leaves an imaginary smaller square and each corner panel is a square having an area substantially one-fourth that of the smaller square so as to provide a complete double-thickness bottom.

6. The method according to claim 1, further characterized in that cutting the sheet is performed in such fashion as to leave each corner panel connected to the smaller rectangle by a relatively narrow, elongated neck lying generally on an extended diagonal of the smaller rectangle, and folding of each corner is achieved by folding its neck transversely to its length.

7. The method according to claim 6, in which the sheet is a square, and each neck is folded at an angle of 90° to its length.

8. The one-piece container formed from a single rectangular sheet of fiber board pre-cut to provide a bottom, a pair of end panels, a pair of side panels and four corner panels all separated from each other but integral with and connected to the bottom, said end and side panels projecting upwardly from the bottom to provide structure and the four corner panels being folded beneath the bottom to double the thickness of the bottom.

9. The container according to claim 8, further characterized in that each corner has edge portions projecting laterally beyond the bottom.

10. The container according to claim 9, further characterized in that the edge portions of the corners provide a peripheral lip bordering the structure.

* * * * *